US007673933B2

(12) United States Patent
Lawson

(10) Patent No.: US 7,673,933 B2
(45) Date of Patent: Mar. 9, 2010

(54) RECLINER LIFT CHAIR WITH DUAL MOTORS

(75) Inventor: Greg Lawson, Tupelo, MS (US)

(73) Assignee: Omega Motion L.L.C., Saltillo, MS (US)

( * ) Notice: Subject to any disclaimer, the term of this patent is extended or adjusted under 35 U.S.C. 154(b) by 120 days.

(21) Appl. No.: 12/031,892

(22) Filed: Feb. 15, 2008

(65) Prior Publication Data

US 2008/0290710 A1 Nov. 27, 2008

Related U.S. Application Data

(60) Provisional application No. 60/890,021, filed on Feb. 15, 2007.

(51) Int. Cl.
*A47C 1/02* (2006.01)

(52) U.S. Cl. ..... 297/69; 297/85 M

(58) Field of Classification Search ..... 297/69, 297/85 M, 85 C, 84, 423.19, 423.25, 423.28, 297/330, 342

See application file for complete search history.

(56) References Cited

U.S. PATENT DOCUMENTS 3,934,927 A * 1/1976 Zur ..... 297/69
4,386,803 A * 6/1983 Gilderbloom ..... 297/84
4,691,964 A * 9/1987 Morgan ..... 297/330
5,865,457 A 2/1999 Knabusch et al.
5,868,461 A 2/1999 Brotherston
6,154,899 A 12/2000 Brooke et al.
6,840,575 B2 * 1/2005 Hesse ..... 297/85 M

* cited by examiner

*Primary Examiner*—Milton Nelson, Jr.
(74) *Attorney, Agent, or Firm*—Myers Bigel Sibley & Sajovec

(57) ABSTRACT

A seating unit comprises: a base; a seat; a backrest; at least one ottoman; a reclining mechanism attached to the base, seat, backrest and ottoman; an ottoman power unit attached to the base and to the reclining mechanism; and a backrest power unit attached to the base and to the reclining mechanism. The reclining mechanism is configured to move the seating unit from the upright position to a TV position, in which the ottoman is generally horizontally disposed in front of the seat, and from the TV position to a fully reclined position, in which the backrest is reclined relative to the seat. The ottoman power unit is configured to drive the seating unit between the upright and TV positions. The backrest power unit is configured to drive the seating unit between the TV and fully reclined positions.

14 Claims, 8 Drawing Sheets

RECLINER LIFT CHAIR WITH DUAL MOTORS

RELATED APPLICATION

This application claims priority from U.S. Provisional Patent Application No. 60/890,021, filed Feb. 15, 2007 and entitled RECLINER LIFT CHAIR WITH DUAL MOTORS, the disclosure of which is hereby incorporated herein in its entirety.

FIELD OF THE INVENTION

The present invention is directed to furniture, and more particularly to reclining seating units.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest that provides support for the occupant's feet in the reclined position.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor. In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position.

It may be desirable to provide a reclining chair with additional functionality.

SUMMARY OF THE INVENTION

As a first aspect, embodiments of the present invention are directed to a seating unit. The seating unit comprises: a base; a seat; a backrest; at least one ottoman; a reclining mechanism attached to the base, seat, backrest and ottoman; an ottoman power unit attached to the base and to the reclining mechanism; and a backrest power unit attached to the base and to the reclining mechanism. The reclining mechanism is configured to move the seating unit from the upright position to a TV position, in which the ottoman is generally horizontally disposed in front of the seat, and from the TV position to a fully reclined position, in which the backrest is reclined relative to the seat. The ottoman power unit is configured to drive the seating unit between the upright and TV positions. The backrest power unit is configured to drive the seating unit between the TV and fully reclined positions.

As a second aspect, embodiments of the present invention are directed to a seating unit comprising: a base; a seat; a backrest; at least one ottoman; a reclining mechanism attached to the base, seat, backrest and ottoman; an ottoman power unit attached to the base and to the reclining mechanism; and a backrest power unit attached to the base and to the reclining mechanism. The reclining mechanism is configured to move the seating unit from the upright position to a TV position, in which the ottoman is generally horizontally disposed in front of the seat, and from the TV position to a fully reclined position, in which the backrest is reclined relative to the seat. The ottoman power unit is configured to drive the seating unit between the upright and TV positions. The backrest power unit is configured to drive the seating unit between the TV and fully reclined positions. Actuation of the ottoman power unit and movement of the seating unit between the upright and TV positions moves the backrest power unit relative to the base. During actuation of the backrest power unit and movement of the seating unit between the TV and fully reclined positions, the ottoman remains substantially stationary relative to the base.

DETAILED DESCRIPTION OF EMBODIMENTS OF THE INVENTION

Figure 1:
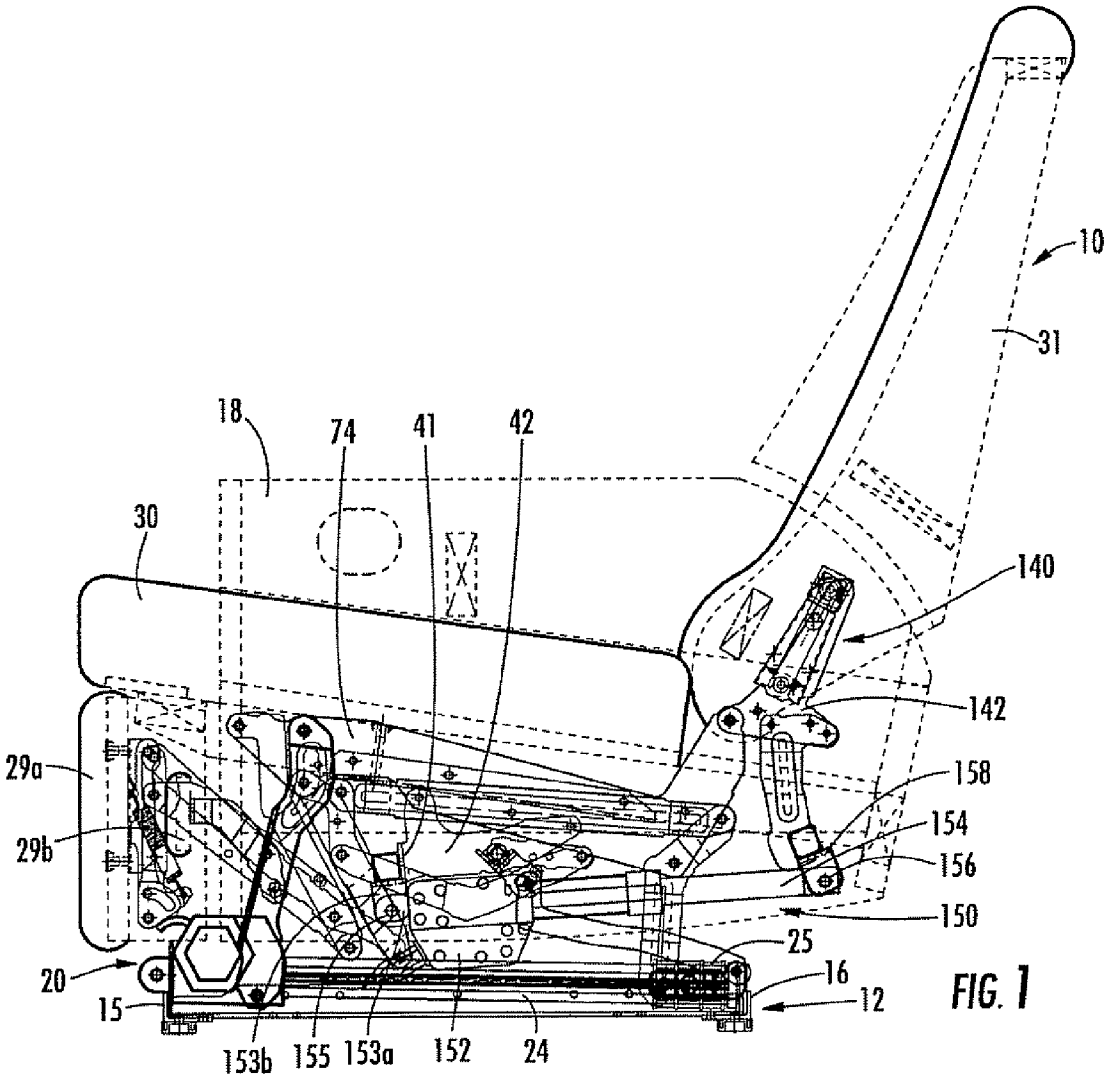
FIG. 1 is a side section view of an embodiment of a recliner chair of the present invention, with the chair shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on". "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating unit between its armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating unit illustrated and described herein comprises a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, FIG. 1 shows a reclining chair, designated broadly at 10, in its upright position. The chair 10 includes a base 12, a seat 30, a backrest 31, and front and intermediate ottomans 29*a*, 29*b*. These components are moveable relative to one another between a closed position (shown in FIGS. 1, 2, 5 and 6), a TV position (shown in FIGS. 3 and 7) and a fully reclined position (FIG. 4); movement between these positions is controlled by a pair of mirror image reclining mechanisms 26 shown in FIGS. 2-7. For clarity of illustration, the reclining mechanisms 26 will be described first with respect to the upright position (best seen in FIGS. 2 and 6). Subsequently, the movements of the mechanisms 26 between the aforementioned positions will be described. Because the reclining mechanisms 26 are mirror images of each other, only one reclining mechanism 26 will be described herein in detail, with the understanding that this description is equally applicable to the other reclining mechanism 26.

Figure 2:
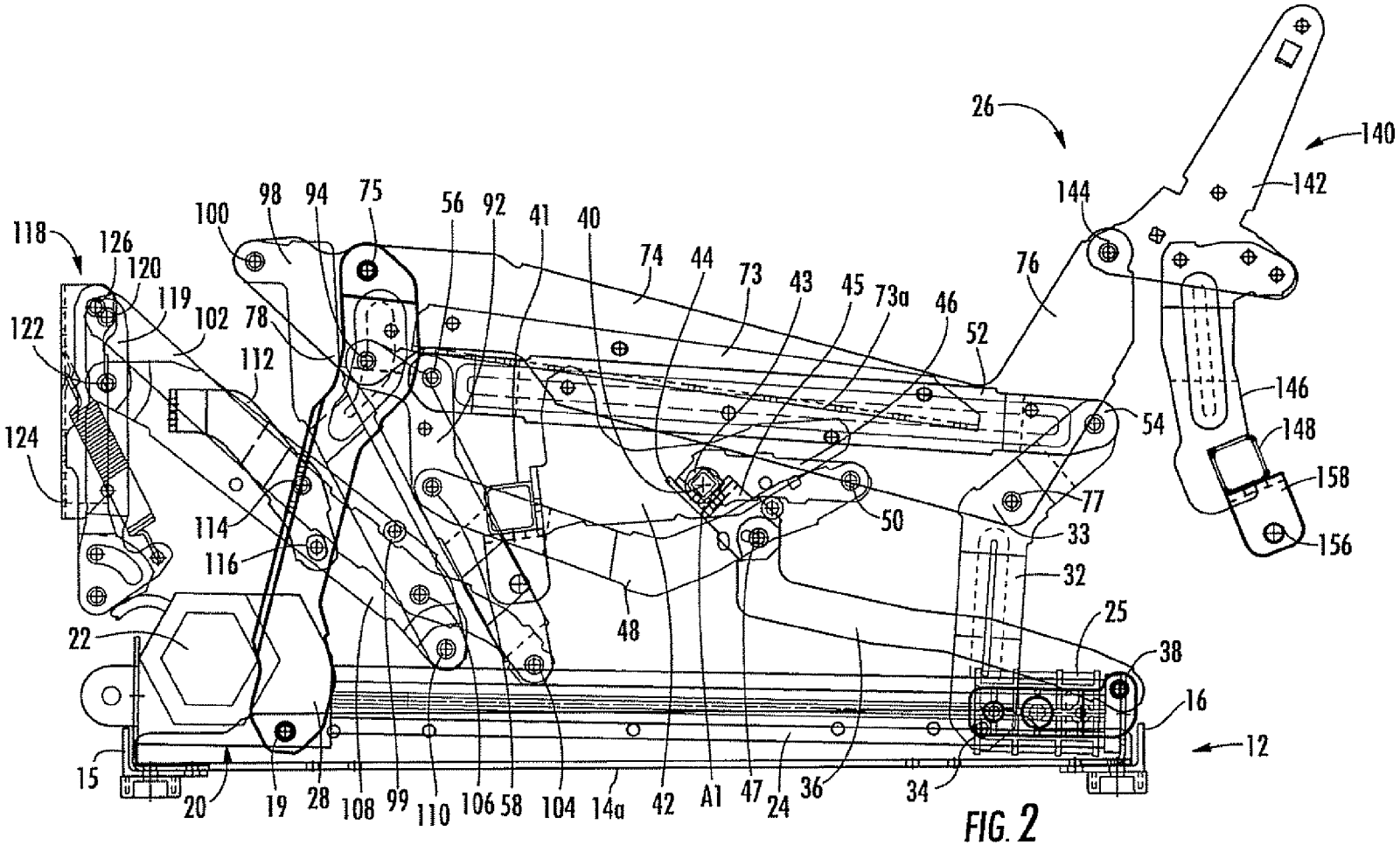
FIG. 2 is a side section view of the reclining mechanism and ottoman motor unit of the chair of FIG. 1 shown in the closed position.
Figure 5:
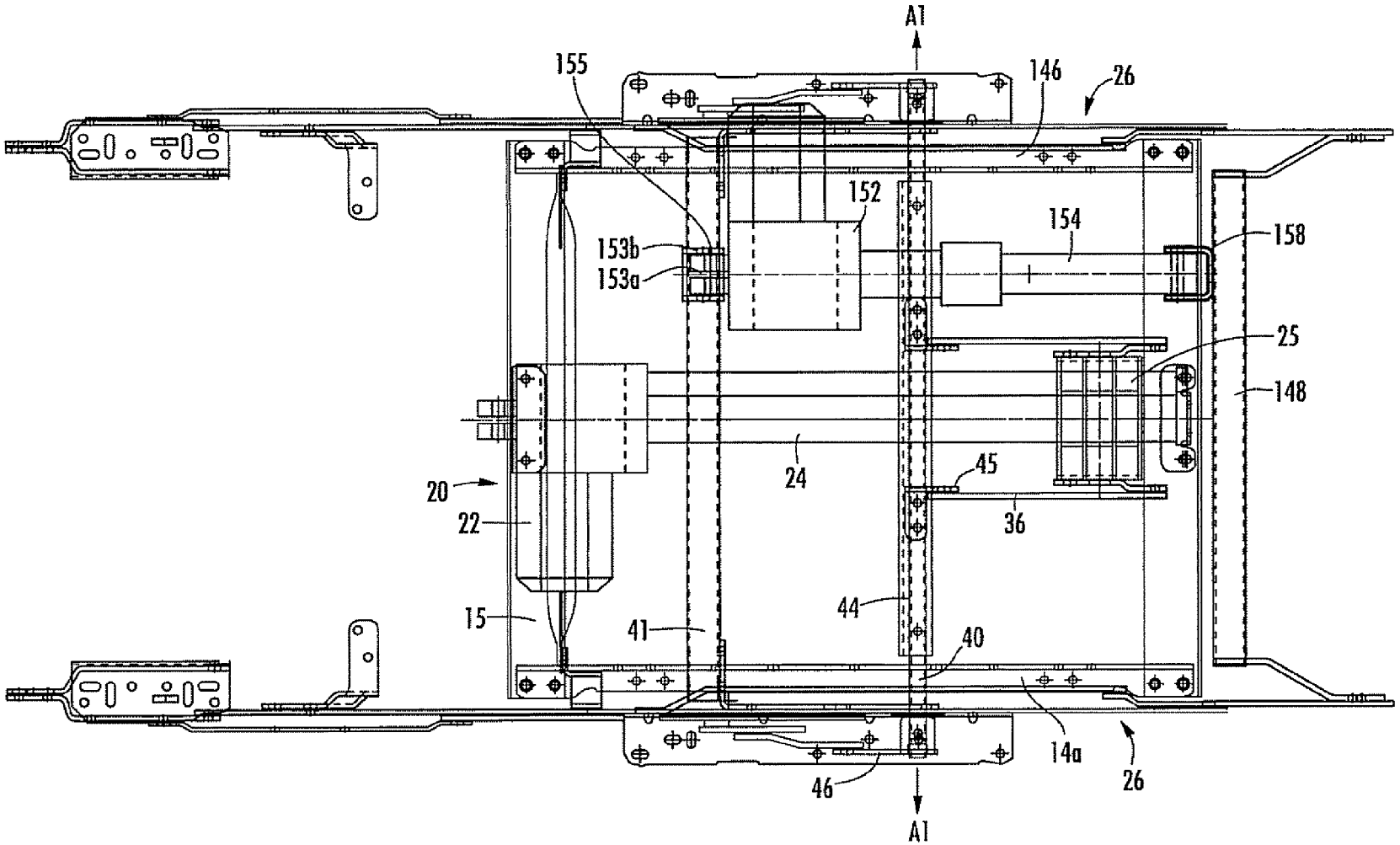
FIG. 5 is a top view of the motor unit and reclining mechanisms of the chair of FIG. 1 shown in the fully reclined position.

Looking now at FIGS. 1, 2 and 5, the base 12 comprises a pair of longitudinally-extending rails 14*a*, 14*b* on opposite sides of the chair 10. A front cross-rail 15 spans the forward ends of the rails 14*a*, 14*b*, and a rear cross-rail 16 spans the rearward end of the rails 14*a*, 14*b*. Arms 18 are mounted to and above the rails 14*a*, 14*b*. A mounting plate 42 having a hole 43 is attached to the inboard surface of each of the arms 18. An L-shaped cross-member 41 extends between the mounting plates 42.

Referring still to FIGS. 1, 2 and 5, an ottoman power unit 20 is fixed to the base 12. A motor 22 is fixed to the front cross-rail 15. A rail 24 extends rearwardly from the motor 22 and is fixed to the rear cross-rail 16. A traveler 25 is mounted on the rail 24 and can translate longitudinally thereon in response to activation from a power source (typically an electrical outlet via an electrical cord).

Referring to FIGS. 1 and 2, the reclining mechanism 26 is interconnected with the ottoman power unit 20 via a transition link 36, which is pivotally attached to the traveler 25 at a pivot 38 and extends forwardly and upwardly therefrom. An axle 40 extends transversely between the holes 43 in the mounting plates 18 on opposite sides of the chair 10 and is free to rotate about a drive axis A1. An L-shaped mounting bracket 44 is fixed to the axle 40; a crank tab 45 extends rearwardly and downwardly from the mounting bracket 44 and is pivotally interconnected with the forward end of the transition link 36 at a pivot 47. A drive finger 46 is also fixed to the mounting bracket 44 and extends generally rearwardly therefrom.

Figure 6:
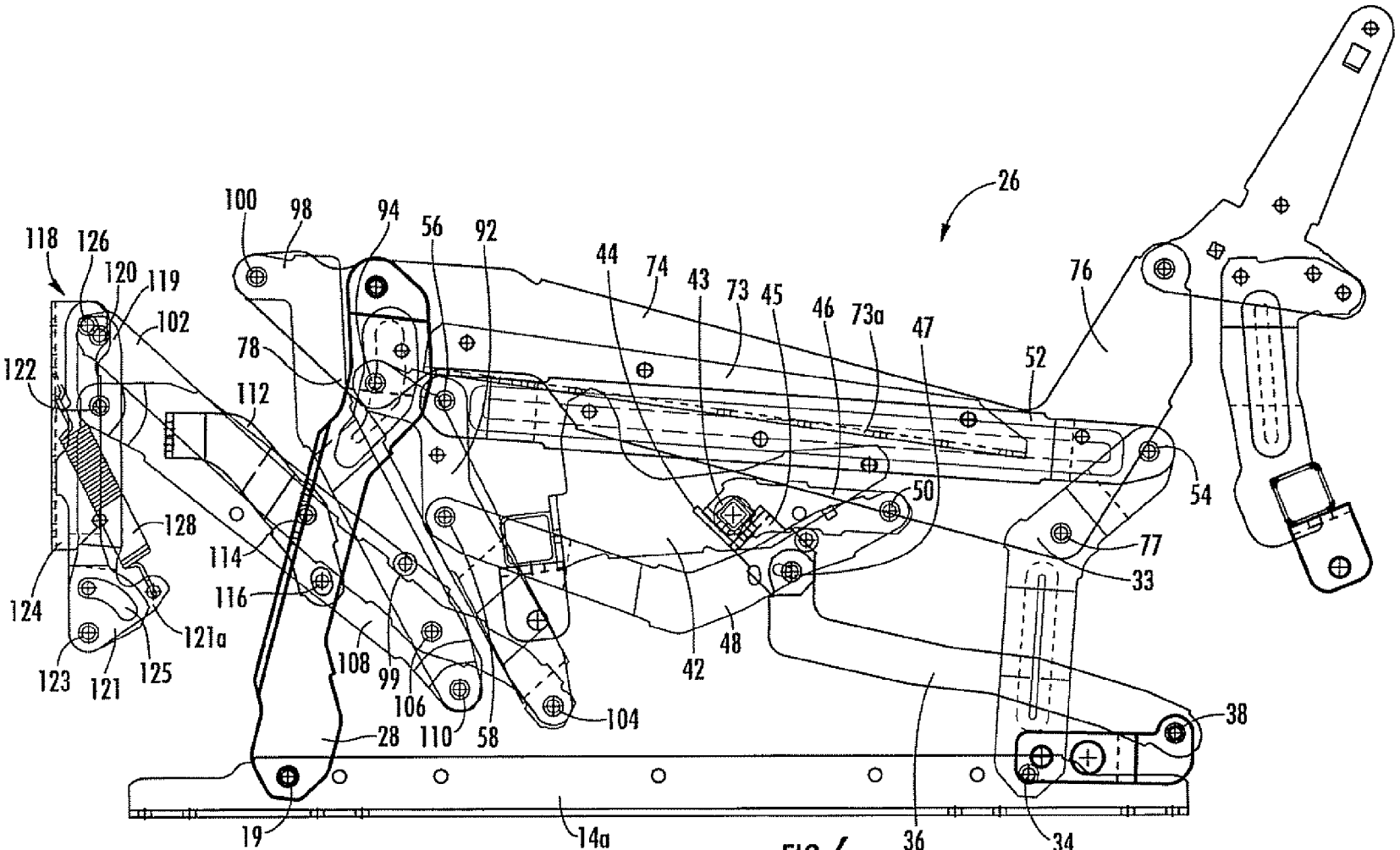
FIG. 6 is a side section view of the reclining mechanism of the chair of FIG. 1 shown in the upright position.

Referring now to FIGS. 2 and 6, the seat 30 is mounted to a seat mounting bracket 73 that includes an laterally-extending flange 73*a*. The seat mounting bracket 73 is fixed to a seat plate 74 that extends much of the length of the chair 10. The seat plate 74 includes an upper projection 76 at its rear end and a lower projection 78 on a forward portion of its lower edge. The seat plate 74 (and, in turn, the seat 30) is interconnected with the base 12 via two swing links: a front swing link 28 and a rear swing link 32. The front swing link 28 is a relatively straight link that is attached to the rail 14*a* at a pivot 19 and extends generally upwardly therefrom to attach to the seat plate 74 at a pivot 75 located above the lower projection 78. The rear swing link 32 is an angled link with a vertex 33; the lower end of the rear swing link 32 is attached to the rail 14*a* at a pivot 34, and the vertex 33 is attached to the seat plate 74 at a pivot 77 located below the upper projection 76.

The seat 30 is connected with the ottoman power unit 20 in the following manner (FIGS. 1 and 2). A connecting link 52 is attached at its rearward end to the upper end of the rear swing link 32 at a pivot 54 and extends forwardly therefrom. An angled ottoman drive link 48 is attached to the rear end of the drive finger 46 at a pivot 50 and extends generally forwardly therefrom. The connecting link 52 and the ottoman drive link 48 each terminate at pivots 56, 58, respectively, with a lower ottoman swing link 92. The lower ottoman swing link 92 is attached at its upper, forward end to the lower projection 78 of the seat plate 74 at a pivot 94, extends rearwardly to the pivot 56, downwardly to the pivot 54, then rearwardly and downwardly therefrom.

To interconnect the ottomans 29*a*, 29*b* with the remainder of the reclining mechanism 26, an upper ottoman swing link 98 is pivotally attached at a pivot 100 to the forward end of the seat plate 74 and extends generally parallel to the lower ottoman swing link 92. A pin 99 is attached and projects transversely from the upper ottoman swing link 98. An upper ottoman extension link 102 is attached to the lower end of the lower ottoman swing link 92 at a pivot 104 and to a lower portion of the upper ottoman swing link 98 at a pivot 106. The upper ottoman extension link 102 extends forwardly and upwardly to a pivot 120 with a base link 119 of a front ottoman assembly 118. A lower ottoman extension link 108 extends generally parallel to the upper ottoman extension link 102 from a pivot 110 with the lower end of the upper ottoman swing link 98 to a pivot 122 with the base link 119. An intermediate ottoman bracket 112 is attached at its lower end to the central portion of the lower ottoman extension link 108 at a pivot 116 and extends upward and forwardly through a pivot 114 with the upper ottoman extension link 102 to provide a vertical mounting location for the intermediate ottoman 29*b*.

In the upright position, the ottomans 29*a*, 29*b* are locked in position with two "over-center" arrangements of pivots. More specifically, the pivots 104, 58, 94 are in an "over-center" arrangement, as are the pivots 106, 108, 100). The presence of these over-center conditions can help to maintain the ottomans 29*a*, 29*b* secured in the upright position until the occupant of the chair 10 is ready to move the chair 10 to the TV position.

Figure 8:
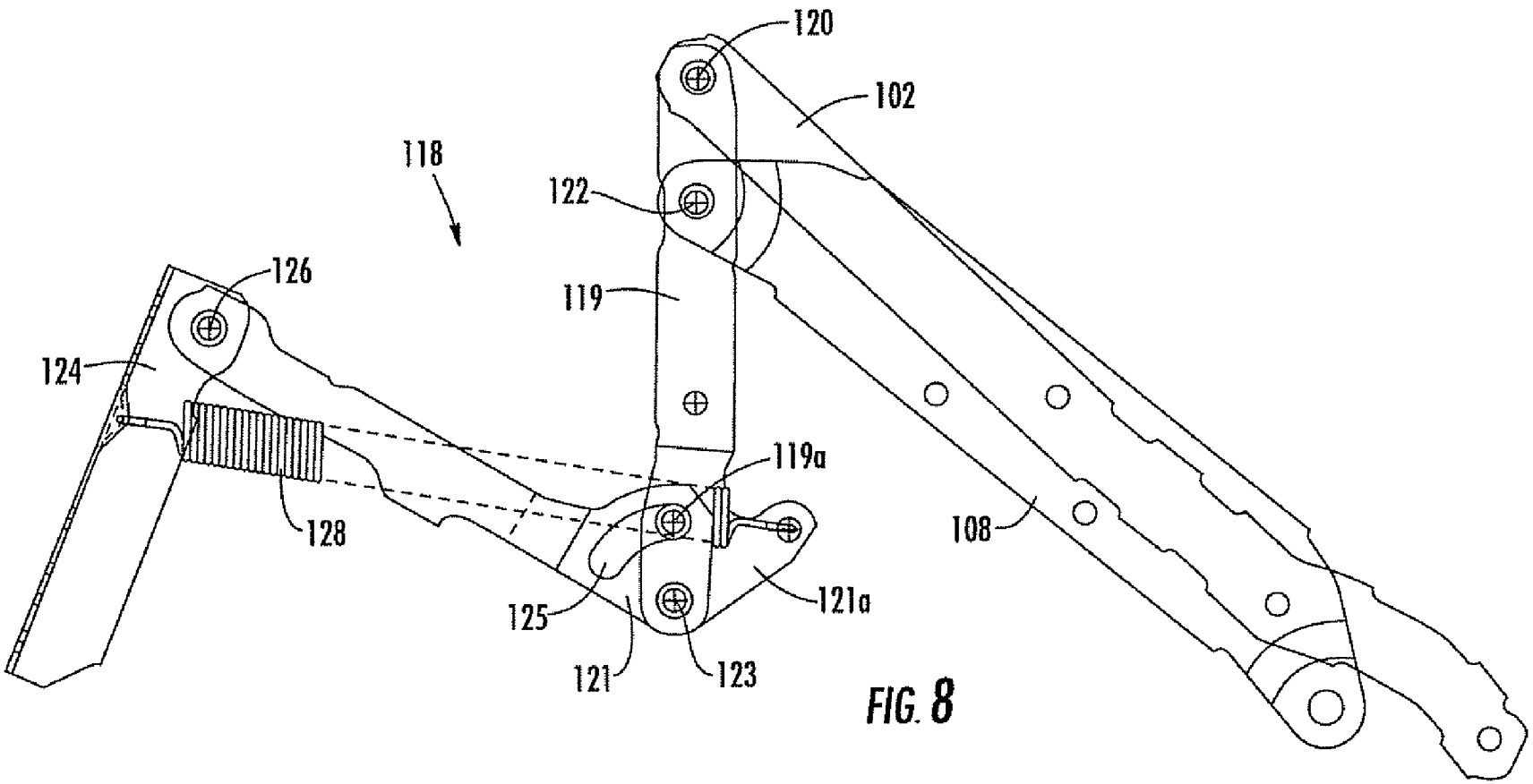
FIG. 8 is an enlarged side view of the footrest assembly of the chair of FIG. 1.

Referring now to FIGS. 6 and 8, the front ottoman assembly 118 includes the aforementioned base link 119, which extends downwardly beyond the pivot 122. A spring link 121 is attached to the lower end of the base link 119 at a pivot 123 and extends upwardly therefrom parallel to the base link 119. The spring link 121 includes a slot 125 toward its lower end that receives a pin 119*a* that projects from the base link 119. The spring link 121 also includes an extension 121*a* that extends upwardly and rearwardly from the pivot 123. A front ottoman bracket 124, to which the front ottoman 29*a* is mounted, is attached to the upper end of the spring link 121 at a pivot 126. The front ottoman bracket 124 is generally vertically disposed so that the front ottoman 29*a* can serve as the front panel of the chair 10. A spring 128 extends between the extension 121*a* and the front ottoman bracket 124 and is in tension to urge the spring link 121 to remain generally parallel to the front ottoman bracket 124.

Turning now to the portion of the reclining mechanism 26 that moves the backrest 31 from an upright disposition in the TV position (FIGS. 3 and 7) to more reclined disposition in the fully reclined position (FIG. 4), a backpost assembly 140 includes a generally T-shaped backpost link 142 that is attached at one end to the upper projection 76 of the seat link 74 at a pivot 144. The backpost assembly 140 also includes a backpost bracket 146 that is fixed to the lower portion of the backpost link 142 and extends downwardly therefrom. A cross-member 148 extends between the lower ends of the backpost bracket 146 on opposite sides of the chair 10.

A backrest power unit 150 includes a motor 152 and a retractable rod 154. The motor 152 is fixed to a mounting bracket 153*a* which is, in turn, attached at a pivot 155 to a mounting bracket 153*b* that is fixed to the cross-member 41. The rear end of the rod 154 is attached via a pivot 156 to a mounting bracket 158 that is fixed to the cross-member 148 of the backpost assembly 140.

Figure 3:
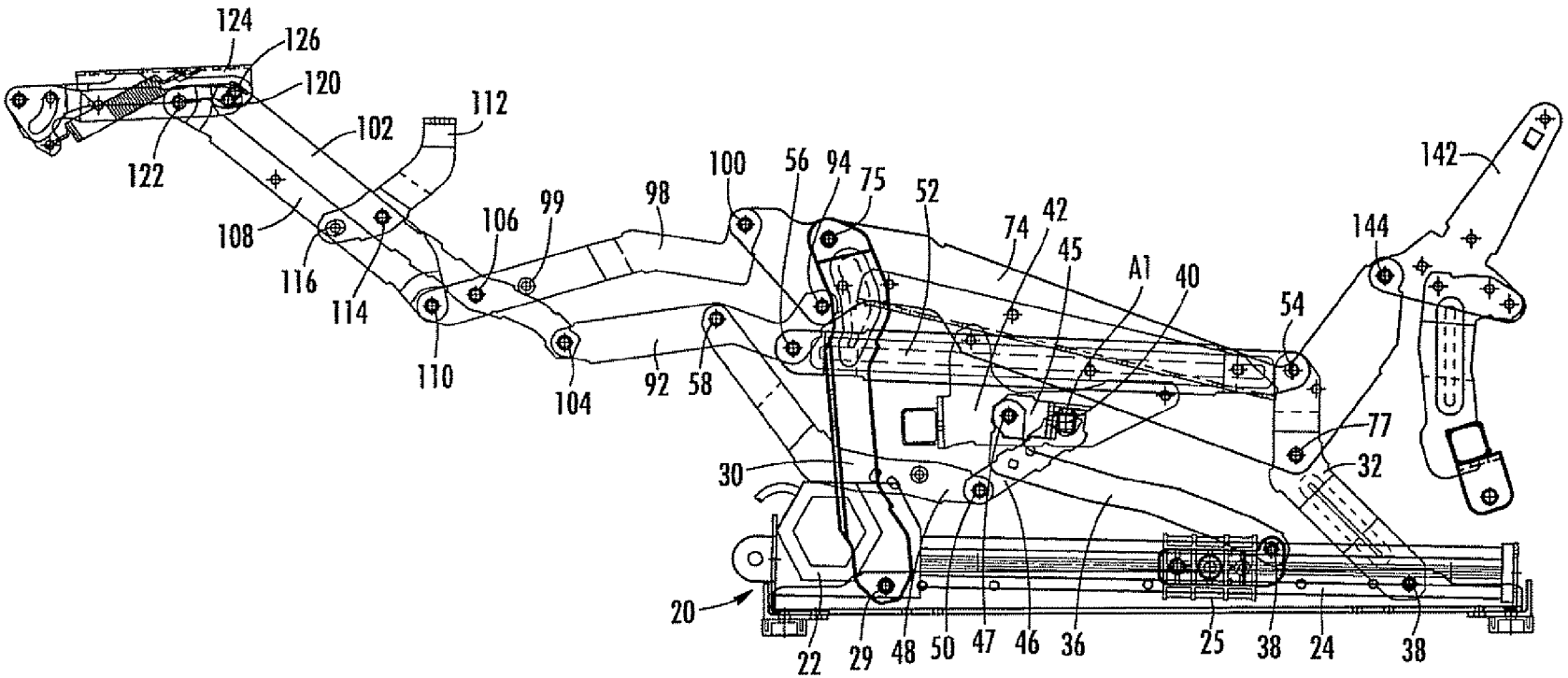
FIG. 3 is a side section view of the reclining mechanism and ottoman motor unit of the chair of FIG. 1 shown in the TV position.
Figure 7:
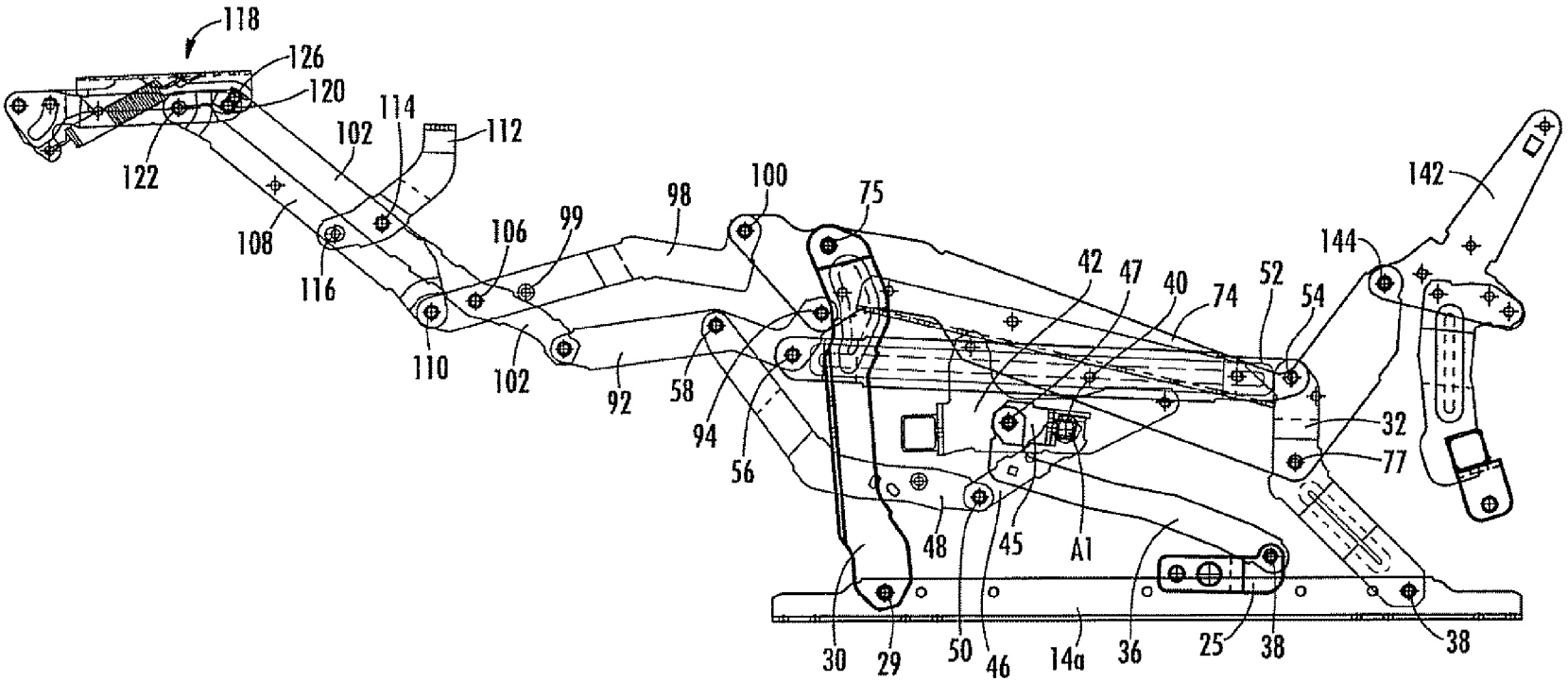
FIG. 7 is a side section view of the reclining mechanism of the chair of FIG. 1 shown in the TV position.

To move the chair 10 from the upright position of FIGS. 1, 2 and 6 to the TV position of FIGS. 3 and 7, the occupant of the chair 10 energizes the motor 22 of the ottoman motor unit 20 (typically via a push button or the like), which causes the traveler 25 to translate forwardly on the rail 24. This action draws the transition link 36 forward, which forces the crank tab 45 and, in turn, the axle 40 and the drive finger 46 to rotate clockwise about the drive axis A1. The rotation of the drive finger 46 forces the ottoman drive link 48 forward. This action causes the lower ottoman swing link 92 to rotate clockwise relative to the seat plate 74. The rotation of the lower ottoman swing link 92 draws the connecting link 52 forwardly, which in turn draws the upper end of the rear swing link 32 forward. As a result, the rear swing link 32 rotates counterclockwise about the pivot 34 and forces the seat plate 74 (and the seat 30) forward relative to the base 12; the movement of the seat plate 74 is also controlled by the front swing link 28, which rotates counterclockwise about the pivot 30.

In addition, the clockwise rotation of the lower ottoman swing link 92 forces the upper ottoman extension link 98 forward, which in turn rotates the upper ottoman swing link 98 about the pivot 100. The forward movement of the upper ottoman swing link 98 drives the lower ottoman extension link 108 forwardly. In moving forward, the lower ottoman extension link 108 moves forward slightly more than the upper ottoman extension link 102, such that the front ottoman assembly 118 rotates clockwise approximately 90 degrees, as does the intermediate ottoman bracket 112. Movement of the reclining assembly 26 ceases when the pin 99 on the upper ottoman swing link 98 contacts the upper edge of the upper ottoman extension link 102 and when the pin 62 on the transition member 58 reaches the lower, rearward end of the slot 40 in the seat base bracket 34.

The movement of the chair 10 to the TV position not only has the effect of extending the front and intermediate ottomans and moving the seat 30 forward, but also of increasing the pitch of the seat 30 relative to the underlying surface. This movement is controlled by the front and rear swing links 28, 32. In moving from the upright to the TV position, the angle of the seat 30 relative to the floor typically changes between about 5 and 15 degrees (in some embodiments, the seat 30 has a pitch angle of between about 5 and 10 degrees in the upright position and between about 12 and 20 degrees in the TV position).

The front ottoman assembly 118 is configured so that, if extreme force is applied to the front ottoman 29*a*, the bracket 124 will release and pivot counterclockwise about the pivot 123 (the movement is shown in FIG. 8). This action can prevent the chair 10 from tipping if, for example, a child jumps onto the front ottoman 29*a* when it is extended.

Figure 4:
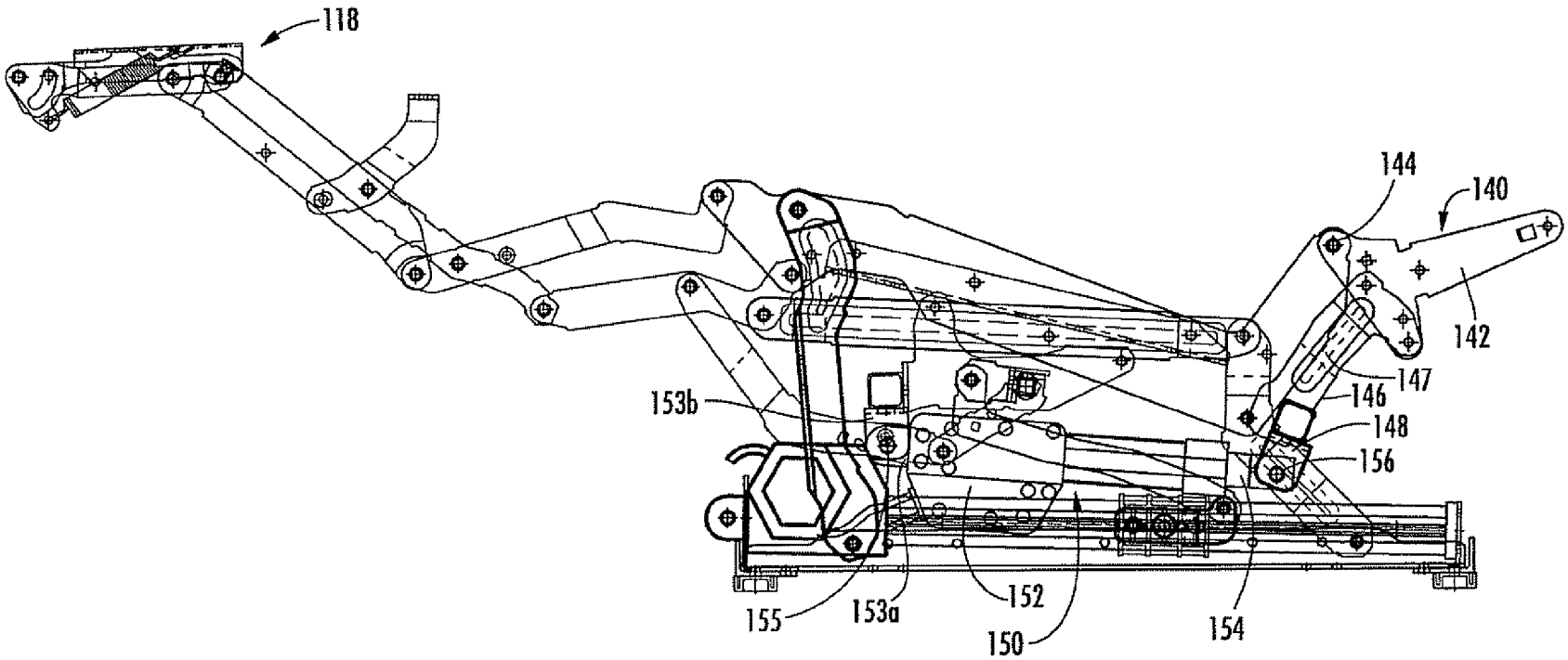
FIG. 4 is a side section view of the reclining mechanism and backrest motor unit of the chair of FIG. 1 shown in the fully reclined position.

An occupant can move the chair 10 from the TV position of FIGS. 3 and 7 to the fully reclined position of FIG. 4 by energizing the motor 152 of the backrest power unit 150 (again, typically with a push button or the like) to retract the rod 154. Retraction of the rod 154 draws the lower end of the backpost bracket 146 forwardly, which causes the backpost link 142 (and, in turn, the backrest 31) to pivot clockwise about the pivot 144. The movement of the backrest 31 ceases when a rib 147 strikes the rear edge of the seat plate 74. Thus, the movement of the backrest 31 is independent of the movement of the ottomans 29*a*, 29*b*.

It can also be seen that both the ottoman power unit 20 and the backrest power unit 150 can be deactivated at any time during their movement. As a result, an occupant of the chair 10 can stop the ottomans 29*a*, 29*b* in any position between the upright and TV positions as desired. Also, the occupant can stop the backrest 31 in any position between the upright and fully reclined positions.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A seating unit, comprising:

a base;

a seat;

a backrest;

at least one ottoman;

a reclining mechanism attached to the base, seat, backrest and ottoman;

an ottoman power unit attached to the base and to the reclining mechanism; and a backrest power unit attached to the base and to the reclining mechanism;

wherein the reclining mechanism is configured to move the seating unit from an upright position to a TV position, in which the ottoman is generally horizontally disposed in front of the seat, and from the TV position to a fully reclined position, in which the backrest is reclined relative to the seat; and wherein the ottoman power unit is configured to drive the seating unit between the upright and TV positions; and wherein the backrest power unit is configured to drive the seating unit between the TV and fully reclined positions;

wherein actuation of the ottoman power unit and movement of the seating unit between the upright and TV positions moves the backrest power unit relative to the base.

2. The seating unit defined in claim 1, wherein the reclining mechanism includes front and rear swing links that are pivotally interconnected with the base and with a seat bracket that supports the seat.

3. The seating unit defined in claim 2, wherein the reclining mechanism includes a connecting link that is pivotally interconnected with the rear swing link and with a lower ottoman swing link that is also pivotally interconnected with the seat bracket.

4. The seating unit defined in claim 1, wherein the reclining mechanism includes a backpost assembly that is fixed to the backrest, and wherein the backpost assembly is pivotally interconnected to the backrest power unit.

5. The seating unit defined in claim 1, wherein the at least one ottoman is mounted on a spring-loaded bracket.

6. The seating unit defined in claim 1, wherein the seat increases in pitch as it moves from the upright position to the TV position.

7. A seating unit, comprising:

a base;

a seat;

a backrest;

at least one ottoman;

a reclining mechanism attached to the base, seat, backrest and ottoman;

an ottoman power unit attached to the base and to the reclining mechanism; and a backrest power unit attached to the base and to the reclining mechanism;

wherein the reclining mechanism is configured to move the seating unit from an upright position to a TV position, in which the ottoman is generally horizontally disposed in front of the seat, and from the TV position to a fully reclined position, in which the backrest is reclined relative to the seat; and wherein the ottoman power unit is configured to drive the seating unit between the upright and TV positions; and wherein the backrest power unit is configured to drive the seating unit between the TV and fully reclined positions; and wherein the seating unit further comprises a frame having a pair of arms on opposite lateral sides thereof, and wherein the backrest power unit moves with the arms as the seating unit moves between the upright and TV positions.

8. A seating unit, comprising:

a base;

a seat;

a backrest;

at least one ottoman;

a reclining mechanism attached to the base, seat, backrest and ottoman;

an ottoman power unit attached to the base and to the reclining mechanism; and a backrest power unit attached to the base and to the reclining mechanism;

wherein the reclining mechanism is configured to move the seating unit from an upright position to a TV position, in which the ottoman is generally horizontally disposed in front of the seat, and from the TV position to a fully reclined position, in which the backrest is reclined relative to the seat; and wherein the ottoman power unit is configured to drive the seating unit between the upright and TV positions;

wherein the backrest power unit is configured to drive the seating unit between the TV and fully reclined positions; and wherein actuation of the ottoman power unit and movement of the seating unit between the upright and TV positions moves the backrest power unit relative to the base; and wherein, during actuation of the backrest power unit and movement of the seating unit between the TV and fully reclined positions, the ottoman remains substantially stationary relative to the base.

9. The seating unit defined in claim 8, wherein the reclining mechanism includes front and rear swing links that are pivotally interconnected with the base and with a seat bracket that supports the seat.

10. The seating unit defined in claim 9, wherein the reclining mechanism includes a connecting link that is pivotally interconnected with the rear swing link and with a lower ottoman swing link that is also pivotally interconnected with the seat bracket.

11. The seating unit defined in claim 8, wherein the reclining mechanism includes a backpost assembly that is fixed to the backrest, and wherein the backpost assembly is pivotally interconnected to the backrest power unit.

12. The seating unit defined in claim 8, wherein the seating unit further comprises a frame having a pair of arms on opposite lateral sides thereof, and wherein the backrest power unit moves with the arms as the seating unit moves between the upright and TV positions.

13. The seating unit defined in claim 8, wherein the seat increases in pitch as it moves from the upright position to the TV position.

14. The seating unit defined in claim 8, wherein the at least one ottoman is mounted on a spring-loaded bracket.

* * * * *